US007635197B2

(12) United States Patent
Man

(10) Patent No.: US 7,635,197 B2
(45) Date of Patent: Dec. 22, 2009

(54) FLASHLIGHT WITH BATTERY CARTRIDGE ASSEMBLY

(75) Inventor: Shiu-Fai Stephen Man, N.T. (HK)

(73) Assignee: Kaper Industrial Limited, N.T. (HK)

( * ) Notice: Subject to any disclaimer, the term of this patent is extended or adjusted under 35 U.S.C. 154(b) by 206 days.

(21) Appl. No.: 11/620,714

(22) Filed: Jan. 7, 2007

(65) Prior Publication Data

US 2008/0165529 A1 Jul. 10, 2008

(51) Int. Cl.
*F21L 4/04* (2006.01)

(52) U.S. Cl. ..... 362/202; 362/194; 362/208

(58) Field of Classification Search ..... 362/204, 362/196, 189, 157, 194, 195, 201, 208, 202; 429/179, 178, 98, 99, 100
See application file for complete search history.

(56) References Cited

U.S. PATENT DOCUMENTS 1,487,428 A * 3/1924 Balderston ..... 429/99
2,486,909 A * 11/1949 Babajoff ..... 200/61.79
3,707,055 A * 12/1972 Pearce ..... 446/485
4,013,881 A * 3/1977 Sargent ..... 362/102
4,249,234 A * 2/1981 Park et al. ..... 362/228
4,265,984 A * 5/1981 Kaye ..... 429/178
4,570,208 A * 2/1986 Sassmannshausen ..... 362/188
4,644,451 A * 2/1987 Chabria ..... 362/189
4,819,140 A * 4/1989 Griffin ..... 362/189
5,353,208 A * 10/1994 Moore ..... 362/202
5,709,964 A * 1/1998 Christensen et al. ..... 429/153
5,909,952 A * 6/1999 Guthrie et al. ..... 362/205
5,911,497 A * 6/1999 Mele ..... 362/202
5,993,022 A * 11/1999 Neyer et al. ..... 362/199
6,283,611 B1 * 9/2001 Sharrah et al. ..... 362/205
6,386,730 B1 * 5/2002 Matthews ..... 362/184
6,851,828 B1 * 2/2005 Hansen ..... 362/203
7,186,002 B2 * 3/2007 Matthews et al. ..... 362/205

* cited by examiner

*Primary Examiner*—Gunyoung T Lee

(57) ABSTRACT

The present invention relates to a flashlight with battery cartridge assembly which comprises a case disposed with a light source assembly and a battery cartridge assembly which is removably inserted into the case, wherein the battery cartridge assembly comprises a battery cartridge and an end cap which are fixedly connected with each other, and a switch is disposed between the battery cartridge and the end cap, and the battery cartridge is in a tubular shape for housing one or more batteries, and one end of the battery cartridge which faces the light source assembly is disposed with a first electric contact and a second electric contact, both of which are electrically connected to the light source assembly respectively, and the other end of the battery cartridge which faces the end cap is disposed with a third electric contact and a fourth electric contact, both of which are electrically connected to the switch respectively. The present invention can be manufactured and assembled easier and therefore involves lower manufacturing costs and has lower dimensional variance. It also effectively prevents the end cap and the battery cartridge from being lost.

14 Claims, 6 Drawing Sheets

FLASHLIGHT WITH BATTERY CARTRIDGE ASSEMBLY

BACKGROUND OF THE INVENTION

The present invention relates to a flashlight and more particularly pertains to a flashlight with battery cartridge assembly.

Flashlights of varying construction are known in the art. A conventional flashlight generally comprises a light source such as a light emitting diode, one or more batteries as power source, a switch controlling the on/off status of the light source, contacts making electrical connection of the light source, the battery or batteries and the switch, thereby completing the circuit, and a case which houses the components of the flashlight and is typically in tubular shape serving as a handle for the flashlight. In more complicated designs of available flashlights, a battery cartridge for holding the battery or batteries may be installed to better position the battery or batteries. FIGS. 1 and 2 show the construction and the circuit of a typical aluminum alloy flashlight with rear push button on/off switch. The switch 10 is typically configured as an end cap 20 at the rear of the flashlight so that it may be removable for replacing the battery or batteries 30 in the battery cartridge 60. To complete the circuit, the inner wall of the case 40 is used as an electro-contact, with one end of the case 40 connected electrically to the light source 50 and the other end of the case 40 connected electrically to the switch 10. More specifically, the case 40 is connected to the switch 10 by coupling the threads on one end of the case 40 to the corresponding threads on the end cap 20 and the threads on the end cap 20 are electrically connected to the switch 10. However, in order to enhance the hardness of the case and to improve its aesthetic value, the case 40 of a typical aluminum alloy flashlight usually has to undergo an anodizing process. After the anodizing process, the surface, including the threads of the case 40 becomes electrically non-conductive. Therefore, in order to complete the circuit, it is necessary for the inner wall and the threads of the case 40 to undergo another machining process so as to remove the anodized layer and to reveal the electrically conductive aluminum underneath. The drawback of such construction is that it involves higher manufacturing costs and requires more time and higher level of technical and material investment. It also has higher dimensional variance. During the manufacturing process, it is also not uncommon for the end cap 20 to be fastened to the case 40 with the cartridge 60 being missed to be inserted into the case 40, and this drawback affects product quality and to prevent this, more resources are to be invested on better quality control. Further, when the end cap 20 is removed, the battery cartridge 60 and/or the end cap 20 may be easily lost rendering the flashlight useless.

BRIEF SUMMARY OF THE INVENTION

In view of the aforesaid disadvantages now present in the prior art, the present invention provides a flashlight with battery cartridge assembly. It can be manufactured and assembled easier and therefore involves lower manufacturing costs and has lower dimensional variance. It also effectively prevents the end cap and the battery cartridge from being lost.

To attain this, the present invention generally comprises a flashlight with battery cartridge assembly which comprises a case disposed with a light source assembly and a battery cartridge assembly which is removably inserted into the case, wherein the battery cartridge assembly comprises a battery cartridge and an end cap which are fixedly connected with each other, and a switch is disposed between the battery cartridge and the end cap, and the battery cartridge is in a tubular shape for housing one or more batteries, and one end of the battery cartridge which faces the light source assembly is disposed with a first electric contact and a second electric contact, both of which are electrically connected to the light source assembly respectively, and the other end of the battery cartridge which faces the end cap is disposed with a third electric contact and a fourth electric contact, both of which are electrically connected to the switch respectively.

In one preferred embodiment, the battery cartridge houses three batteries, and the first electric contact and the third electric contact are electrically connected to each other via the three batteries arranged in series, and the second electric contact and the fourth electric contact are electrically connected to each other via a metal connector.

The metal connector may take the form of a metal strip disposed along a side of the battery cartridge.

The second electric contact, the fourth electric contact and the metal connector may be integrally formed as a whole.

In another preferred embodiment, the battery cartridge houses four batteries, and the first electric contact and the third electric contact are electrically connected to each other via three batteries arranged in series, and the second electric contact and the fourth electric contact are electrically connected to each other via a fourth battery.

In a further preferred embodiment, the battery cartridge houses four batteries, and the first electric contact and the third electric contact are electrically connected to each other via two batteries arranged in series, and the second electric contact and the fourth electric contact are electrically connected to each other via the other two batteries arranged in series.

The first electric contact may take the form of a metal spring and the third electric contact may take the form of a metal plate.

The second electric contact may take the form of a metal flange.

The second electric contact may also take the form of a metal plate, and an end of the light source assembly facing the battery cartridge is disposed with a metal flange which connects to the second electric contact.

The fourth electric contact may take the form of a metal plate.

The battery cartridge is fixedly connected with the end cap by a connecting means disposed on the battery cartridge, and a through hole is disposed on the connecting means allowing the switch and the battery cartridge to be in contact.

The fourth electric contact is electrically connected with the switch by means of a metal bracket, and the metal bracket is electrically connected to the switch and disposed between the switch and the connecting means.

The connecting means is in the form of a circular disc screwed to the battery cartridge with perpendicularly disposed pillarets at intervals for hooking onto the inner wall of the end cap and a centered through hole.

A spring is disposed between the battery cartridge and the end cap, longitudinally biasing against the two at its two ends, so as to ensure consistent electric contact between the battery cartridge and the light source assembly even if the end cap is slightly loosened.

An end of the case which faces the end cap is disposed with threads, and an end of the end cap which faces the case is disposed with threads corresponding to the threads on the case, and the battery cartridge assembly can be removably fixed inside the case by means of coupling the threads of the end cap with the threads of the case.

The switch may take the form of a microswitch.

The inner wall and the threads of the case are electrically non-conductive.

It is an object of the present invention to provide a flashlight with battery cartridge assembly. It has less loose parts and components and does not require addition of any electrically conductive screw threads to the end cap or the inner wall of the case. Therefore, it can be manufactured and assembled easier and it involves lower manufacturing costs and has lower dimensional variance.

It is another object of the present invention to provide a flashlight with battery cartridge assembly with the battery cartridge fixedly connected with the end cap, thereby effectively preventing the end cap and the battery cartridge from being lost.

It is a further object of the present invention to provide a flashlight with battery cartridge assembly which is integrally formed, thereby effectively preventing the battery cartridge from being missed to be inserted into the case of the flashlight.

DETAILED DESCRIPTION OF THE INVENTION

Figure 1:
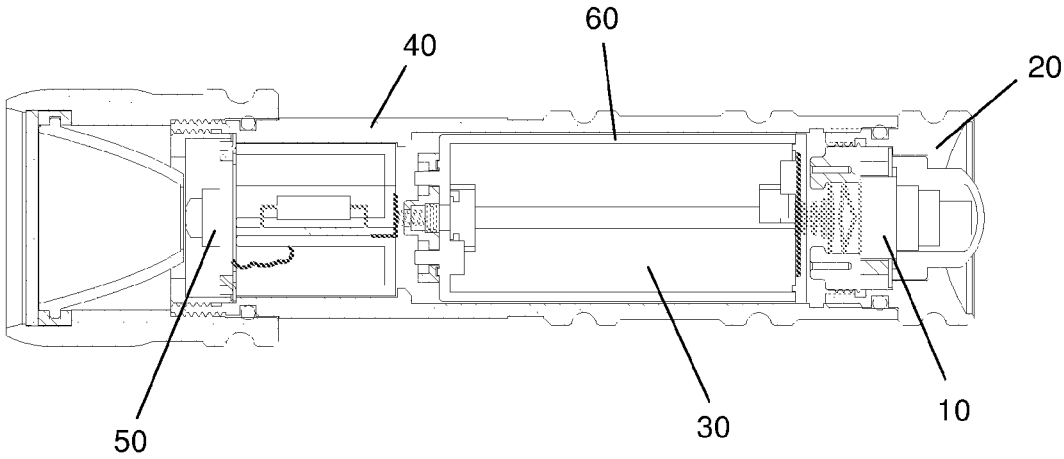
FIG.1 (PRIOR ART)
FIG. 1 shows a cross-sectional view of a typical aluminum alloy flashlight with rear push button on/off switch.
Figure 2:
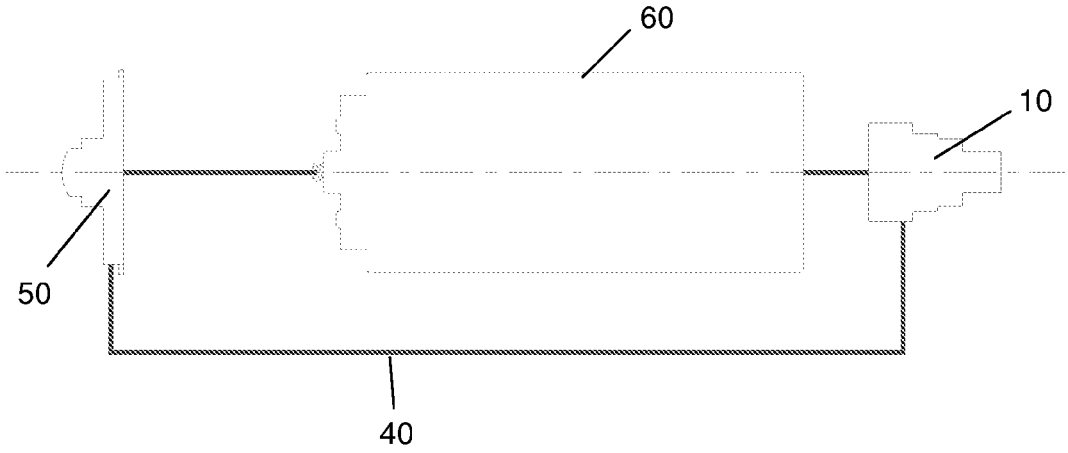
FIG.2 (PRIOR ART)
FIG. 2 shows a circuit diagram of the flashlight as shown in FIG. 1.
Figure 3:
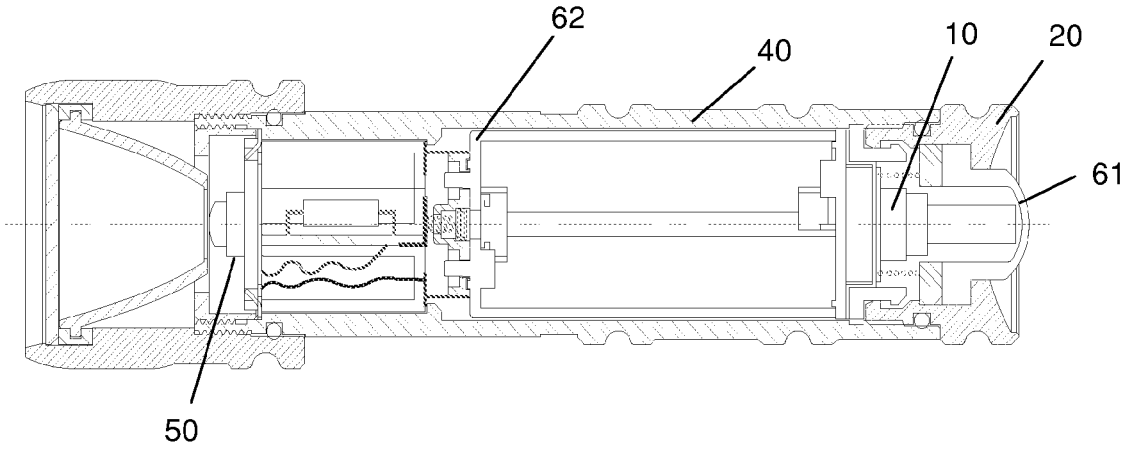
FIG. 3 shows a cross-sectional view of the first embodiment of the present invention.
Figure 4:
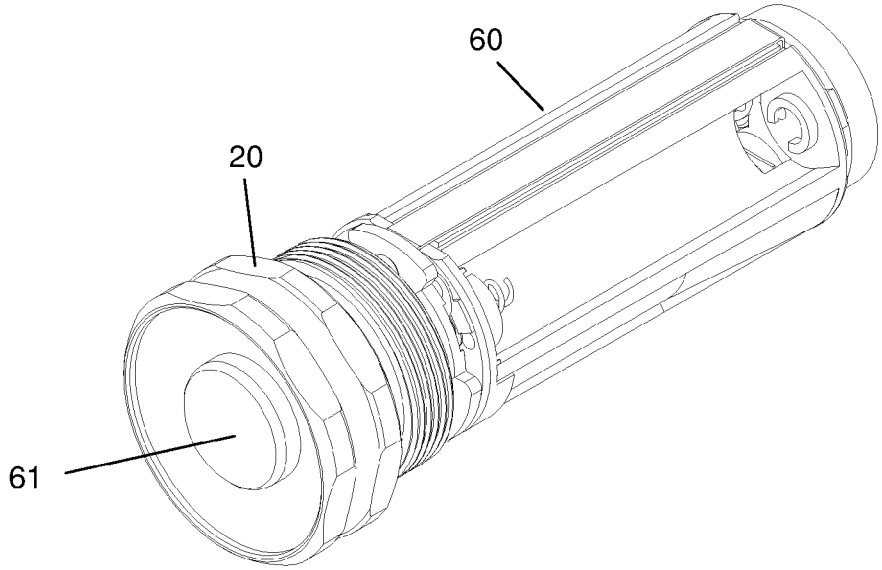
FIG. 4 shows a perspective view of the battery cartridge assembly of the first embodiment of the present invention.
Figure 5:
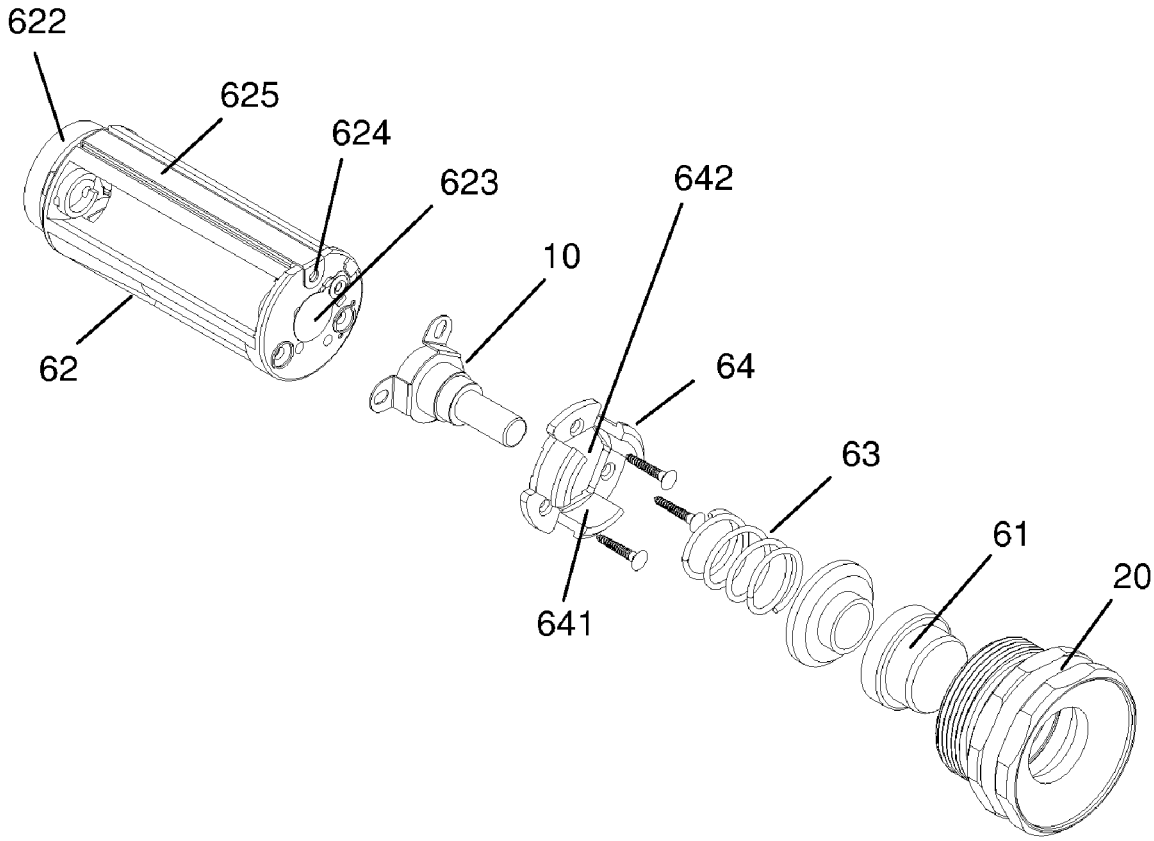
FIG. 5 shows an exploded view of the battery cartridge assembly of the first embodiment of the present invention.
Figure 6:
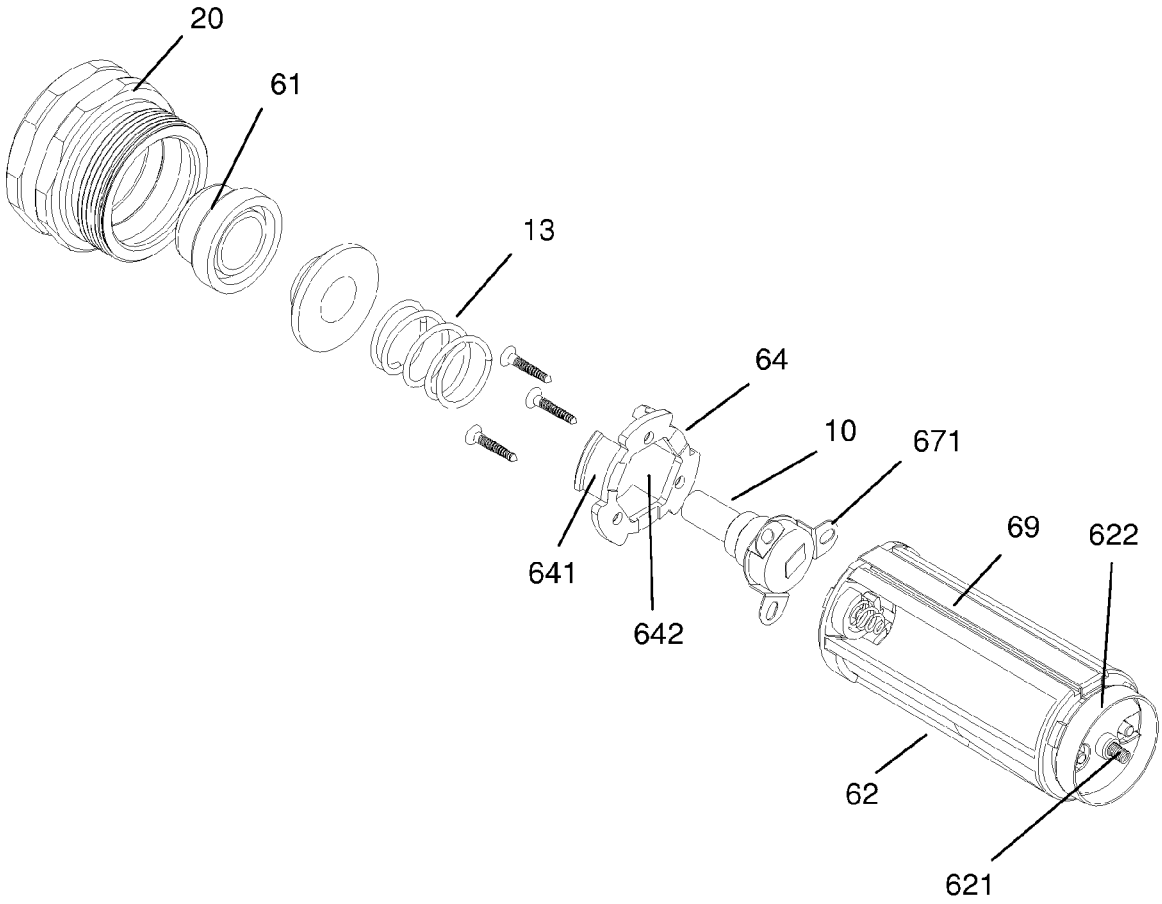
FIG. 6 shows another exploded view of the battery cartridge assembly of first embodiment of the present invention.

Referring to FIGS. 3 to 6, the first embodiment of the present invention comprises a case 40 disposed with a light source assembly 50 and a battery cartridge assembly 60 which can be removably inserted into the case 40. The battery cartridge assembly 60 generally comprises a battery cartridge 62 and an end cap 20 which are fixedly connected with each other, and a switch 10 is disposed between the battery cartridge 62 and the end cap 20. Similar to conventional flashlights, a push button 61 is connected with the switch 10 and exposed outside the end cap 20 so that users may press the push button 61 to activate the switch 10. In the present embodiment, the battery cartridge 62 is in a tubular shape for housing three batteries. The switch 10 is a conventional microswitch. As the mechanism of the microswitch is similar to conventional microswitch available in the marketplace, the details thereof are not described herein.

In the present embodiment, an end of the case 40 which faces the end cap 20 is disposed with threads, and an end of the end cap 20 which faces the case 40 is disposed with threads corresponding to the threads on the case 40, and the battery cartridge assembly 60 can be removably fixed inside the case 40 by means of coupling the threads of the end cap 20 with the threads of the case 40. Other means of connection can be used in other embodiments.

The battery cartridge 62 is fixedly connected with the end cap 20. In the present embodiment, the connection is achieved by means of a connecting means in the form of a circular disc 64 screwed to the battery cartridge 62 with perpendicularly disposed pillarets 641 at intervals and a centered through hole 642. The pillarets 641 hook onto the inner wall of the end cap 20, thereby connecting the battery cartridge 62 and the end cap 20. In other embodiments, the connection can be achieved by other means. The switch 10 passes through the through hole 642 of the circular disc 64 and is in electrical contact with the battery cartridge 62. A spring 63 rests around the switch 10 within the hollow space between the battery cartridge 62 and the end cap 20.

One end of the battery cartridge 62 which faces the light source assembly 50 is disposed with a first electric contact 621 and a second electric contact 622, both of which are electrically connected to the light source assembly 50 respectively. The other end of the battery cartridge 62 which faces the end cap 20 is disposed with a third electric contact 623 and a fourth electric contact 624, both of which are electrically connected to the switch 10 respectively. In the present embodiment, the first electric contact 621 takes the form of a metal spring and the third electric contact 623 takes the form of a metal plate. The second electric contact 622 is in the form of a metal flange and the fourth electric contact 624 is in the form of a metal plate. In another embodiment, the second electric contact 622 may take the form of a metal plate, and an end of the light source assembly 50 facing the battery cartridge 62 is disposed with a metal flange which connects to the second electric contact 622. The second electric contact 622 and the fourth electric contact 624 are connected with each other via a metal connector 625. In the present embodiment, the metal connector 625 takes the form of a metal strip disposed along a side of the battery cartridge 62. The fourth electric contact 624 is electrically connected with the switch 10 by means of a metal bracket 671 electrically connected to the switch 10 and disposed between the battery cartridge 62 and the circular disc 64.

The spring 63 rests in the hollow space between the battery cartridge 62 and the end cap 20. When the battery cartridge 62 and the end cap 20 are integrated together during the manufacturing process, the spring 63 is longitudinally biased against the battery cartridge 62 and the end cap 20 at its two ends, thereby ensuring secure and consistent contact between the first electric contact 621 and the second electric contact 622 of the battery cartridge assembly 60 and the light source assembly 50 and preventing intermittent flashing of the flashlight.

In the present embodiment, a negative terminal of a first battery is electrically connected to the third electric contact 623 of the battery cartridge 62, and a positive terminal of a second battery is electrically connected to the first electric contact 621 of the battery cartridge 62, and a positive terminal and a negative terminal of a third battery are electrically connected to the negative terminal of the second battery and the positive terminal of the first battery respectively. The batteries are electrically connected in series.

Figure 7:
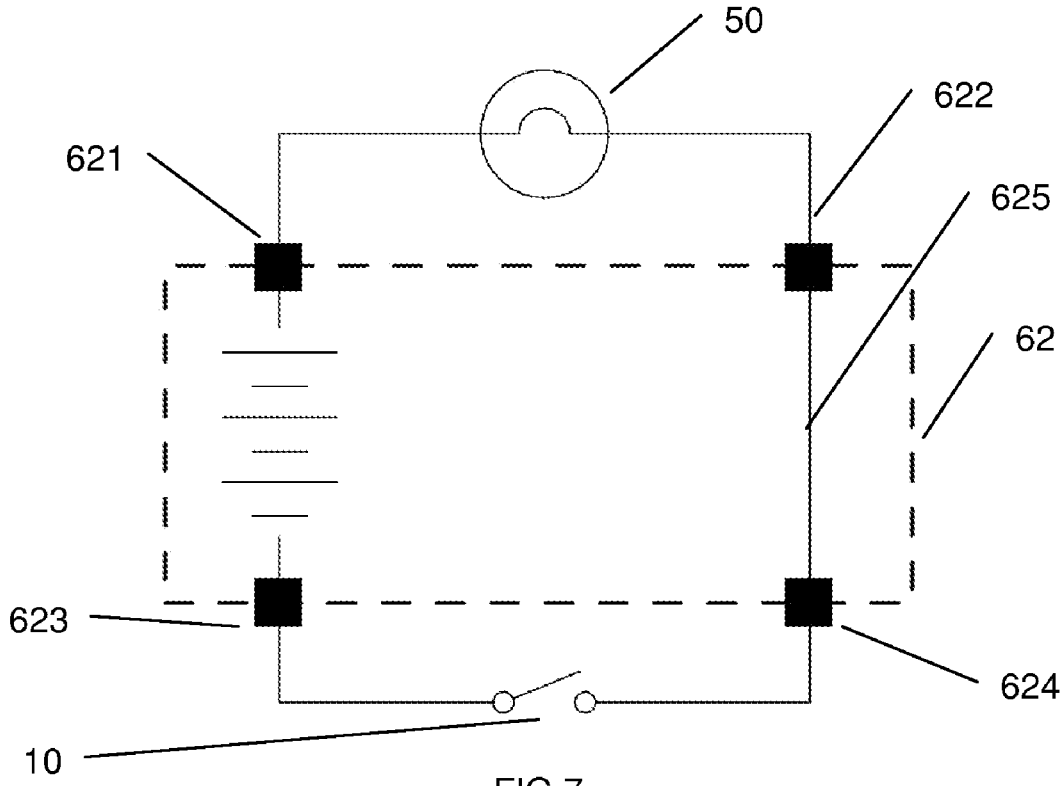
FIG. 7 shows the circuit diagram of the first embodiment of the present invention.

Referring to FIG. 7, the electric circuit of the present embodiment contains the switch 10, the third electric contact 623, the batteries, the first electric contact 621, the light source assembly 50, the second electric contact 622, the metal connector 625 and the fourth electric contact 624. When the switch 10 is activated, the circuit is closed and, powered by the batteries, a current builds up and passes through the light source assembly 50, thereby lighting up the light source assembly 50. Since the batteries are electrically arranged in series, after passing through the switch 10, the current enters the battery cartridge 62 through the third electric contact 623 of the battery cartridge 62. The current then passes through all three batteries, the terminals of which are serially connected by metal wires disposed at the two end plates of the battery cartridge 62 in this embodiment, and leaves the battery cartridge 62 through the first electric contact 621 of the battery cartridge 62 to the light source assembly 50. After passing through the light source assembly 50, the current flows through the second electric contact 622 and along the metal connector 625, then back to the switch 10 at the rear end of the battery cartridge 62 via the fourth electric contact 624. It should be appreciated that the batteries can also be arranged in another way, that is, a negative terminal of a first battery is electrically connected to the first electric contact 621 of the battery cartridge 62, and a positive terminal of a second battery is electrically connected to the third electric contact 623 of the battery cartridge 62, and a negative terminal and a positive terminal of a third battery are electrically connected to the positive terminal of the first battery and the negative terminal of the second battery respectively.

Figure 8:
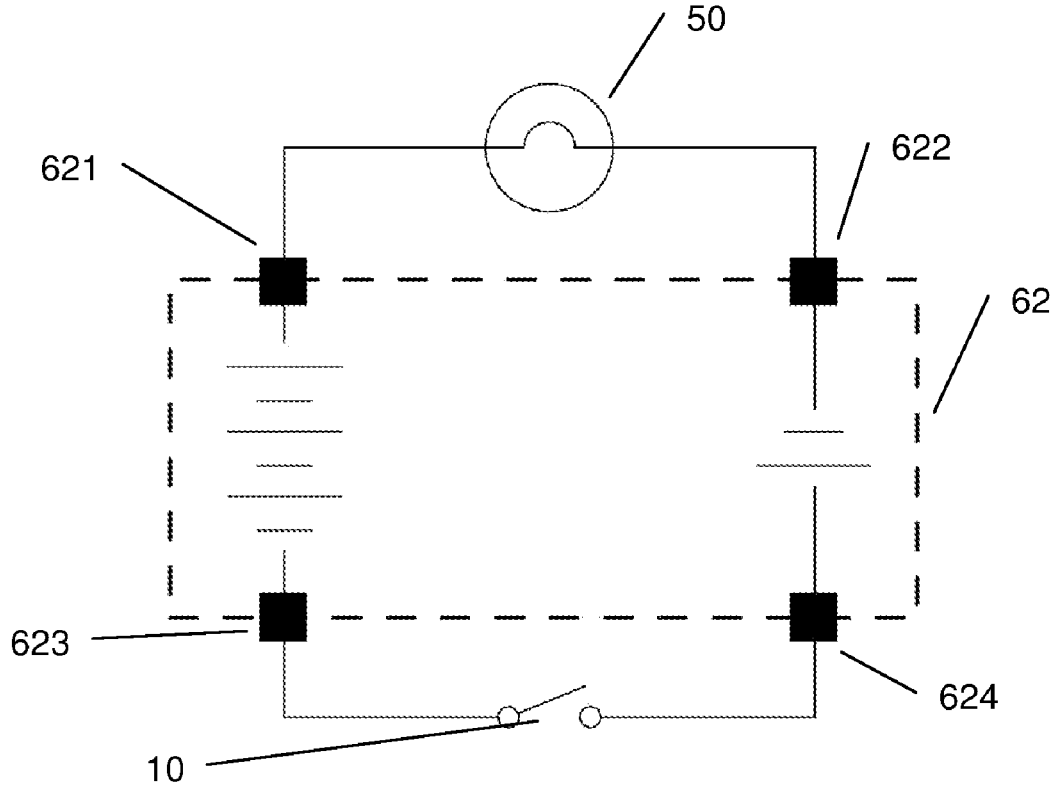
FIG. 8 shows the circuit diagram of the second embodiment of the present invention.

Referring to FIG. 8, in a second embodiment, four batteries are included in the battery cartridge 62. With the first three disposed in the same manner as in the first embodiment, the fourth battery is electrically connected at its negative terminal to the second electric contact 622 and at its positive terminal to the fourth electric contact 624. In this embodiment, the fourth battery serves the function of the metal connector 625 in the first embodiment. The current passes through the following path: the switch 10, the third electric contact 623, the first three batteries of the battery cartridge 62, the first electric contact 621, the light source assembly 50, the second electric contact 622, the fourth battery in the battery cartridge 62 and back to the switch 10 via the fourth electric contact 624. As in the first embodiment, it should also be appreciated that the batteries can be arranged in another way, that is, a negative terminal of a first battery is electrically connected to the first electric contact 621 of the battery cartridge 62, and a positive terminal of a second battery is electrically connected to the third electric contact 623 of the battery cartridge 62, and a negative terminal and a positive terminal of a third battery are electrically connected to the positive terminal of the first battery and the negative terminal of the second battery respectively, and a positive terminal and a negative terminal of a fourth battery are electrically connected to the second electric contact 622 and the fourth electric contact 624 respectively.

Figure 9:
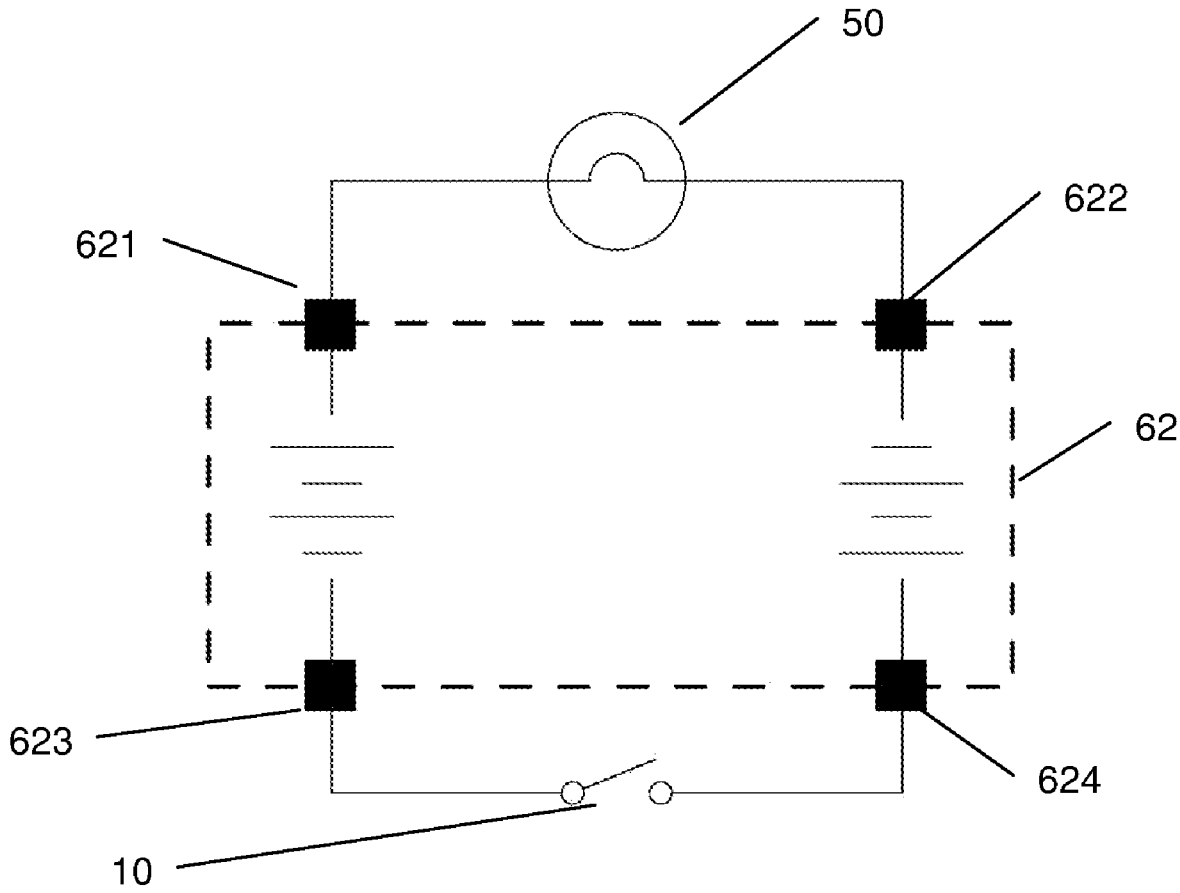
FIG. 9 shows the circuit diagram of the third embodiment of the present invention.

Referring to FIG. 9, in a third embodiment, four batteries are included in the battery cartridge 62. A negative terminal of a first battery is electrically connected to the third electric contact 623 of the battery cartridge 62, and a positive terminal of the first battery is electrically connected to a negative terminal of a second battery, and a positive terminal of the second battery is electrically connected to the first electric contact 621 of the battery cartridge 62, and a negative terminal of a third battery is electrically connected to the second electric contact 622, and a positive terminal of the third battery is electrically connected to a negative terminal of a fourth battery, and a positive terminal of the fourth battery is electrically connected to the fourth electric contact 624. The current passes through the following path: the switch 10, the third electric contact 623, the first two batteries of the battery cartridge 62, the first electric contact 621, the light source assembly 50, the second electric contact 622, the remaining two batteries in the battery cartridge 62 and back to the switch 10 via the fourth electric contact 624. As in the previous embodiments, it should be appreciated that the batteries can be arranged in another way, that is, the positive terminal of a first battery is electrically connected to the third electric contact 623 of the battery cartridge 62, and a negative terminal of the first battery is electrically connected to a positive terminal of a second battery, and a negative terminal of a second battery is electrically connected to the first electric contact 621 of the battery cartridge 62, and a positive terminal of a third battery is electrically connected to the second electric contact 622, and a negative terminal of the third battery is electrically connected to a positive terminal of a fourth battery, and a negative terminal of a fourth battery is electrically connected to the fourth electric contact 624.

As illustrated above, the case 40 is no longer needed for electrical conduction. The inner wall and the threads of the case 40 can therefore stay electrically non-conductive. This saves the machining process and is much more cost effective in manufacturing than the available flashlights.

As to a further discussion of the manner of usage and operation of the present invention, the same should be apparent from the above description. Accordingly, no further discussion relating to the manner of usage and operation is provided.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

The present invention is capable of other embodiments and of being practiced and carried out in various ways. It is to be understood that the phraseology and terminology employed herein are for the purpose of description and should not be regarded as limiting.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed is:

1. A flashlight with battery cartridge assembly which comprises a case disposed with a light source assembly and a battery cartridge assembly which is removably inserted into the case, wherein the battery cartridge assembly comprises a battery cartridge and an end cap which are fixedly connected with each other, and a switch is disposed between the battery cartridge and the end cap, and the battery cartridge is in a tubular shape for housing one or more batteries, and one end of the battery cartridge which faces the light source assembly is disposed with a first electric contact and a second electric contact, both of which are electrically connected to the light source assembly respectively, and the other end of the battery cartridge which faces the end cap is disposed with a third electric contact and a fourth electric contact, both of which are electrically connected to the switch respectively; the battery cartridge is fixedly connected with the end cap by a connecting means disposed on the battery cartridge, and a through hole is disposed on the connecting means allowing the switch and the battery cartridge to be in contact.

2. The flashlight with battery cartridge as in claim 1, wherein the battery cartridge houses three batteries, and the first electric contact and the third electric contact are electrically connected to each other via the three batteries arranged in series, and the second electric contact and the fourth electric contact are electrically connected to each other via a metal connector.

3. The flashlight with battery cartridge as in claim 2, wherein the metal connector takes a form of a metal strip disposed along a side of the battery cartridge.

4. The flashlight with battery cartridge as in claim 2, wherein the second electric contact, the fourth electric contact and the metal connector are integrally formed as a whole.

5. The flashlight with battery cartridge as in claim 1, wherein the battery cartridge houses four batteries, and the first electric contact and the third electric contact are electrically connected to each other via three batteries arranged in series, and the second electric contact and the fourth electric contact are electrically connected to each other via a fourth battery.

6. The flashlight with battery cartridge as in claim 1, wherein the battery cartridge houses four batteries, and the first electric contact and the third electric contact are electrically connected to each other via two batteries arranged in series, and the second electric contact and the fourth electric contact are electrically connected to each other via the other two batteries arranged in series.

7. The flashlight with battery cartridge as in claim 1, wherein the first electric contact takes a form of a metal spring and the third electric contact takes the form of a metal plate.

8. The flashlight with battery cartridge as in claim 1, wherein the second electric contact takes a form of a metal flange.

9. The flashlight with battery cartridge as in claim 1, wherein the second electric contact takes a form of a metal plate, and an end of the light source assembly facing the battery cartridge is disposed with a metal flange which connects to the second electric contact.

10. The flashlight with battery cartridge as in claim 1, wherein the fourth electric contact takes a form of a metal plate.

11. The flashlight with battery cartridge as in claim 1, wherein the connecting means is in form of a circular disc screwed to the battery cartridge with perpendicularly disposed pillarets at intervals for hooking onto the inner wall of the end cap and a centered through hole.

12. The flashlight with battery cartridge as in claim 1, wherein a spring is disposed between the battery cartridge and the end cap, longitudinally biasing against the battery cartridge and the end cap at two ends of the spring, so as to ensure consistent electric contact between the battery cartridge and the light source assembly even if the end cap is slightly loosened.

13. The flashlight with battery cartridge as in claim 1, wherein an end of the case which faces the end cap is disposed with threads, and an end of the end cap which faces the case is disposed with threads corresponding to the threads on the case, and the battery cartridge assembly can be removably fixed inside the case by means of coupling the threads of the end cap with the threads of the case.

14. The flashlight with battery cartridge as in claim 1, wherein the case has an inner wall, and the inner wall and the threads of the case are electrically non-conductive.

* * * * *